US005499640A

United States Patent [19]

Kirkland

[11] Patent Number: 5,499,640

[45] Date of Patent: Mar. 19, 1996

[54] DISHWASHER WITH VENTURI DRAIN

[75] Inventor: Daniel R. Kirkland, Winterville, N.C.

[73] Assignee: White Consolidated Industries, Inc., Cleveland, Ohio

[21] Appl. No.: 393,729

[22] Filed: Feb. 24, 1995

[51] Int. Cl.[6] ..... B08B 17/02

[52] U.S. Cl. ..... 134/56 D; 134/104.1; 134/111; 134/186

[58] Field of Search ..... 134/104.1, 155, 134/186, 111, 115 G, 57 D, 56 D, 58 D; 68/208; 137/888

[56] References Cited

U.S. PATENT DOCUMENTS

| | | | |
|---|---|---|---|
| 2,208,662 | 7/1940 | Clark | 68/208 |
| 2,633,726 | 4/1953 | Rand | 68/208 |
| 2,677,389 | 5/1954 | Jisha et al. | 68/208 X |
| 2,750,779 | 6/1956 | Whyte | 68/208 X |
| 2,894,631 | 7/1959 | Levit et al. | 134/111 X |
| 3,331,374 | 7/1967 | Stewart et al. . | |
| 3,457,929 | 7/1969 | Madden | 134/111 X |
| 3,807,636 | 4/1974 | Fackler . | |
| 4,038,103 | 7/1977 | Grunewald . | |
| 4,092,176 | 5/1978 | Kozai et al. . | |
| 4,168,715 | 9/1979 | Spiegel et al. . | |
| 4,243,431 | 1/1981 | Dingler et al. . | |
| 4,319,599 | 3/1982 | Dingler et al. . | |
| 4,347,861 | 9/1982 | Clearman et al. . | |
| 4,666,347 | 5/1987 | Janssen | 137/888 |
| 4,754,772 | 7/1988 | Nord et al. . | |
| 4,768,532 | 9/1988 | Johnson . | |
| 4,848,382 | 7/1989 | Bertsch et al. . | |
| 4,969,479 | 11/1990 | Lagerstrand . | |
| 4,998,548 | 3/1991 | Lagerstrand . | |
| 5,016,667 | 5/1991 | Tolf . | |
| 5,129,411 | 7/1992 | Lagerstrand . | |
| 5,235,994 | 8/1993 | Comin et al. . | |

FOREIGN PATENT DOCUMENTS

| | | | |
|---|---|---|---|
| 756467 | 4/1956 | United Kingdom | 68/208 |

OTHER PUBLICATIONS

Gosline, J. E. and O'Brien M. P., *The Water Jet Pump, University of California Publications in Engineering,* 1934, pp. 167–190.

*Primary Examiner*—Frankie L. Stinson
*Attorney, Agent, or Firm*—Pearne, Gordon, McCoy & Granger

[57] ABSTRACT

A dishwasher sump is divided into a collection chamber and a pump chamber by a filter. Food particles collect in the collection chamber while filtered wash liquid collects in the pump chamber. The filtered wash liquid is recycled and sprayed on objects in the dishwasher. A venturi jet pump has a suction gap located in the collection chamber and an outlet connected to a drain. At the end of a wash cycle, the wash liquid is pumped through the jet pump thereby entraining fluid and particles from the collection chamber to be carried to the drain.

21 Claims, 4 Drawing Sheets

DISHWASHER WITH VENTURI DRAIN

BACKGROUND OF THE INVENTION

1. Field of the Invention

This invention relates generally to the field of dishwashers and specifically to a venturi drain system.

2. Description of the Related Art

Dishwashers, particularly those used in domestic applications, have a wash chamber conventionally provided with a sump at a lower part of the wash chamber. Wash liquid sprayed on dishes and other objects in the wash chamber flows downwardly into the sump where the liquid collects. Wash liquid in the sump is recycled to be sprayed on the dishes or directed toward a drain. In some installations, separate pumps (a recycling pump and a drain pump) are used to direct the liquid to the appropriate locations. Examples of these dishwashers are shown in U.S. Pat. Nos. 3,331,374 to Stewart, 5,129,411 to Lagerstrand, 4,998,548 to Lagerstrand, 4,038,103 to Grunewald, 4,168,715 to Spiegel, all incorporated herein by reference. In other installations, a single pump may be used in conjunction with a valve system to direct the liquid to either the drain or the wash chamber. An example of this is shown in U.S. Pat. Nos. 4,243,431 to Dingler and 4,848,382 to Bertsch, incorporated herein by reference.

It is desirable to use a single uni-directional motor to reduce cost and complexity and improve efficiency. Food particles and the material from the dishes should not be recycled and should not interfere with the flow of liquid to the dishes. In addition, it would be desirable to isolate the pump from the food and other material to prevent clogging or damage to the pump.

Jet pumps are known for evacuating fluids from containers. Such jet pumps use a venturi effect to entrain fluid into a flow of a driven fluid. These are described in detail in Gosline, J. E. & O'Brien, M. P., *The Water Jet Pump* (Univ. of Calif. Publ. Eng. 1934), incorporated herein by reference. It would be desirable to pump food and other material to the drain with the wash liquid using a jet pump.

SUMMARY OF THE INVENTION

The present invention provides a dishwasher preferably having a uni-directional pump isolated from food and debris. The dishwasher is adapted to recycle wash liquid and pump food, debris, and liquid to a drain.

The invention includes a washer drain system having a wash chamber and a sump in communication with the wash chamber. The sump has first and second sump chambers. A venturi has an inlet in communication with the second sump chamber, a suction gap in communication with the first sump chamber, and an outlet communicable with a drain. The pump is connected for creating a liquid flow through the venturi from the second sump chamber to the drain so as to entrain material from the first sump chamber into the venturi and toward the drain.

The first sump chamber defines a collection chamber for collecting solid material. A filter disposed between the wash chamber and the second sump chamber is sloped to direct food particles to the first sump chamber. The filter separates the first and second sump chambers and defines a liquid flow path from the first sump chamber to the second sump chamber. The filter also separates the wash chamber from the second sump chamber so as to define a liquid flow path from the wash chamber to the second sump chamber. A second filter is disposed between the wash chamber and the first sump chamber, the first filter being finer than the second filter.

The venturi comprises a jet pump having a nozzle spaced from a diffuser to define the suction gap. The diffuser defines a throat and the suction gap is adapted to admit material in the first sump chamber into the throat to be conveyed to the drain. An entrance to the throat is spaced from the nozzle by a distance approximately equal to one and one-half times a diameter of the nozzle.

The pump is operatively disposed between the second sump chamber and the venturi. An inlet of the pump communicates with the second sump chamber and an outlet of the pump communicates with the inlet of the venturi. The pump outlet is also communicable with the wash chamber. A valve communicates the pump outlet with one of the wash chamber and venturi. The system preferably includes only the single, unidirectional pump.

DESCRIPTION OF THE PREFERRED EMBODIMENTS

Figure 1:
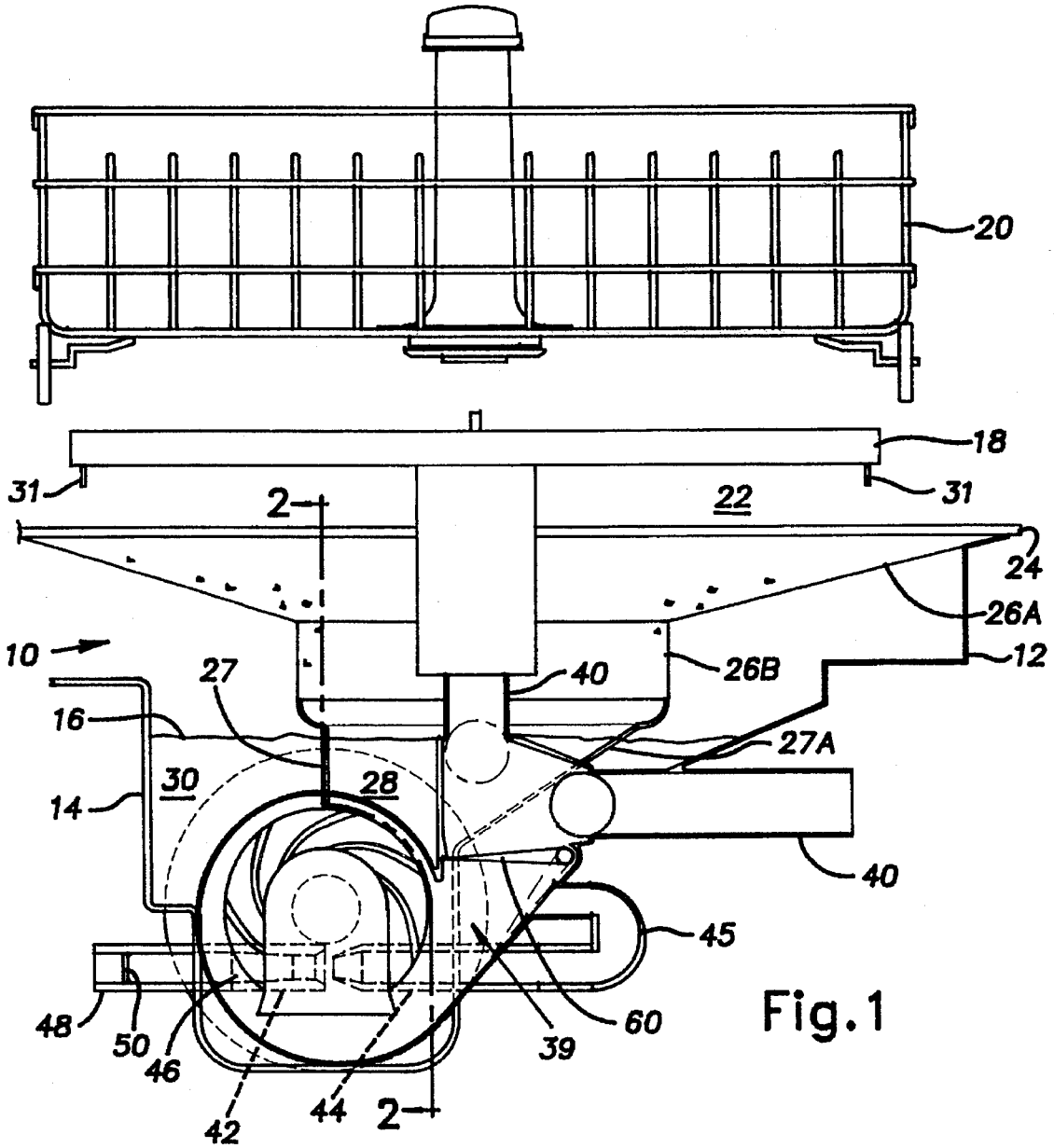
FIG. 1 is a partial elevational view of a dishwasher showing a sump, pump, and drain according to the invention.

Referring to FIG. 1, a dishwasher 10 includes a molded plastic tub 12 having a sump 14 molded therein. The sump 14 collects and holds wash liquid 16 that is sprayed from one or more spray arms 18 onto objects held in a rack 20 inside a wash chamber 22. The wash liquid 16 returns from the wash chamber 22 by force of gravity to the sump 14. A coarse filter 24, such as a grate, is disposed between the wash chamber 22 and the sump 14 to prevent flatware an other large objects from entering the sump 14. A fine filter 26 having a sloped, generally horizontal filter component 26A and an annular vertical filter component 26B is disposed in the sump 14 below the coarse filter 24. The fine filter 26 is preferably a molded mesh screen having 4 mm (0.015 in.) openings. An inner wall 27 of the sump 14 defines an extension of the fine filter 26 and separates the sump 14 into a first chamber, referred to as a collection chamber 28 or quiet chamber, and a second chamber, referred to as a pump chamber 30. The horizontal filter component 26A and a generally horizontal component 27A of the inner wall are sloped downwardly toward the collection chamber 28 to "funnel" food particles from the wash chamber 22 into the collection chamber. Wash liquid flows downwardly through the horizontal component 26A into the pump chamber 30. The fine filter 26 and inner wall 27 isolate the pump chamber 30 from the wash chamber 22 so that food particles and other material in the wash liquid are filtered out before the wash liquid enters the pump chamber 30. In one embodiment of the invention, the horizontal filter component 26A is located directly below the wash arm 18. The wash arm is then provided with a spray nozzle 31 adapted to direct wash liquid at the filter 26A and propel food particles toward the collection chamber 28. Other filter and wall arrangements that filter wash liquid and collect food particles in a chamber are also suitable for the present invention. Food particles are retained in the collection chamber 28 and macerated therein. When the liquid level is high enough, some of the wash liquid in the collection chamber 28 flows through the vertical component **26*b* into the pump chamber 30. In one embodiment of the invention, an additional component of the fine filter can be provided in the inner wall 27** at a lower part of the collection chamber to permit liquid flow from the bottom of the collection chamber into the pump chamber.

Figure 2:
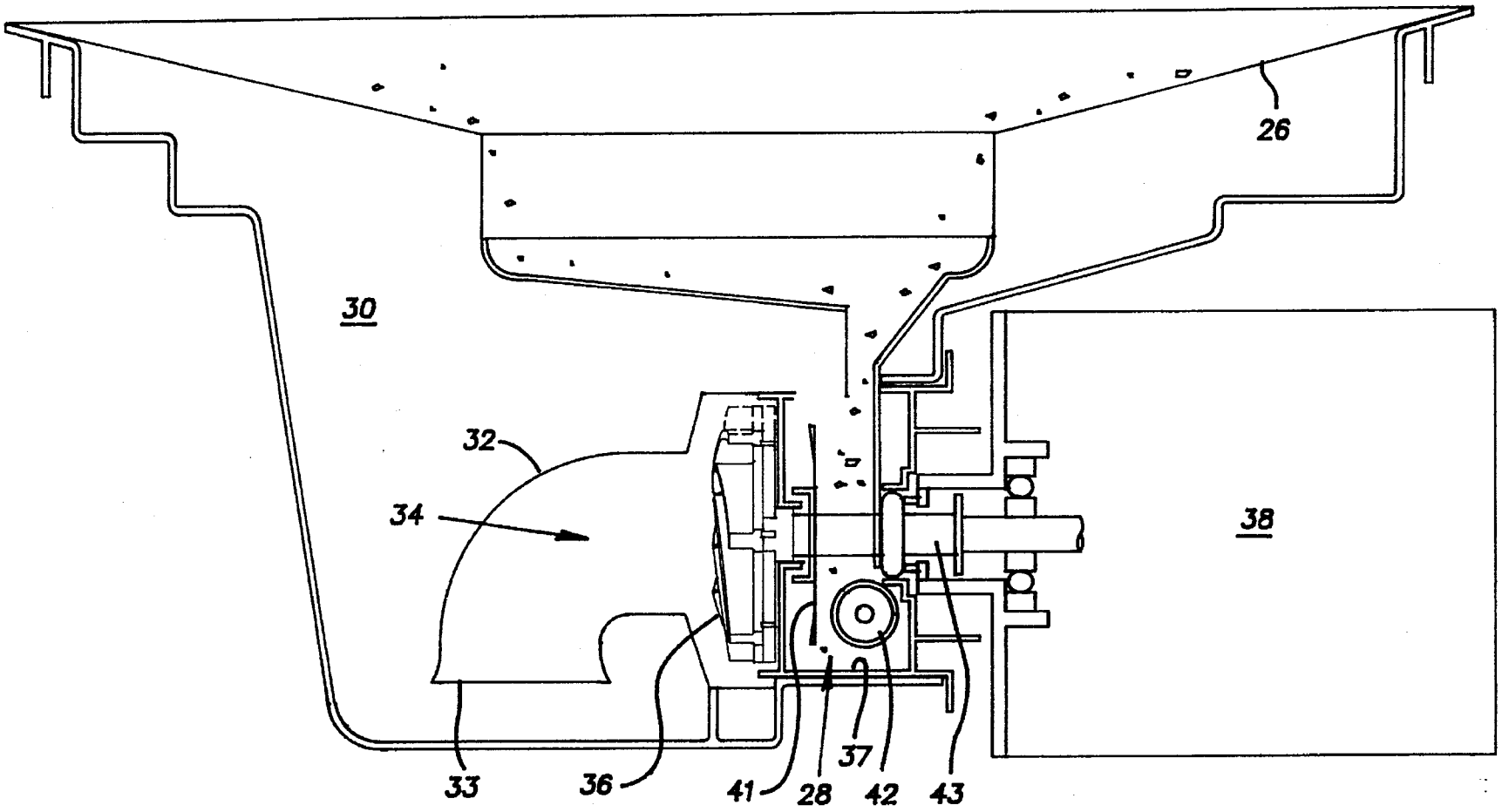
FIG. 2 is an elevational view in a section taken from line 2—2 of FIG. 1.

Referring to FIG. 2, the pump chamber 30 communicates with an inlet 32 of a pump 34 having an impeller 36 driven by a motor 38. A mouth 33 of the inlet 32 is substantially horizontal and disposed at or below the level of a bottom wall 37 of the collection chamber 28 to ensure complete discharge of liquid in the collection chamber. A mincing blade 41 is disposed on a shaft 43 driven by the motor 38. The blade 41 chops the food particles in the collection chamber 28.

Referring to FIG. 1, an outlet 39 of the pump 34 is in communication with one or more conduits 40. The pump 34 moves wash liquid 16 from the pump chamber 30 through the conduit 40 to the spray arm 18. A venturi 42 has a inlet 44 in communication with the pump outlet 39 through a U-pipe 45. An outlet 46 of the venturi 42 communicates with a drain pipe 48 through a check valve 50. A diverter valve 60 operated by a solenoid (not shown) selectively connects the pump outlet 39 to the wash arm conduits 40 or the venturi 42.

Figure 3:
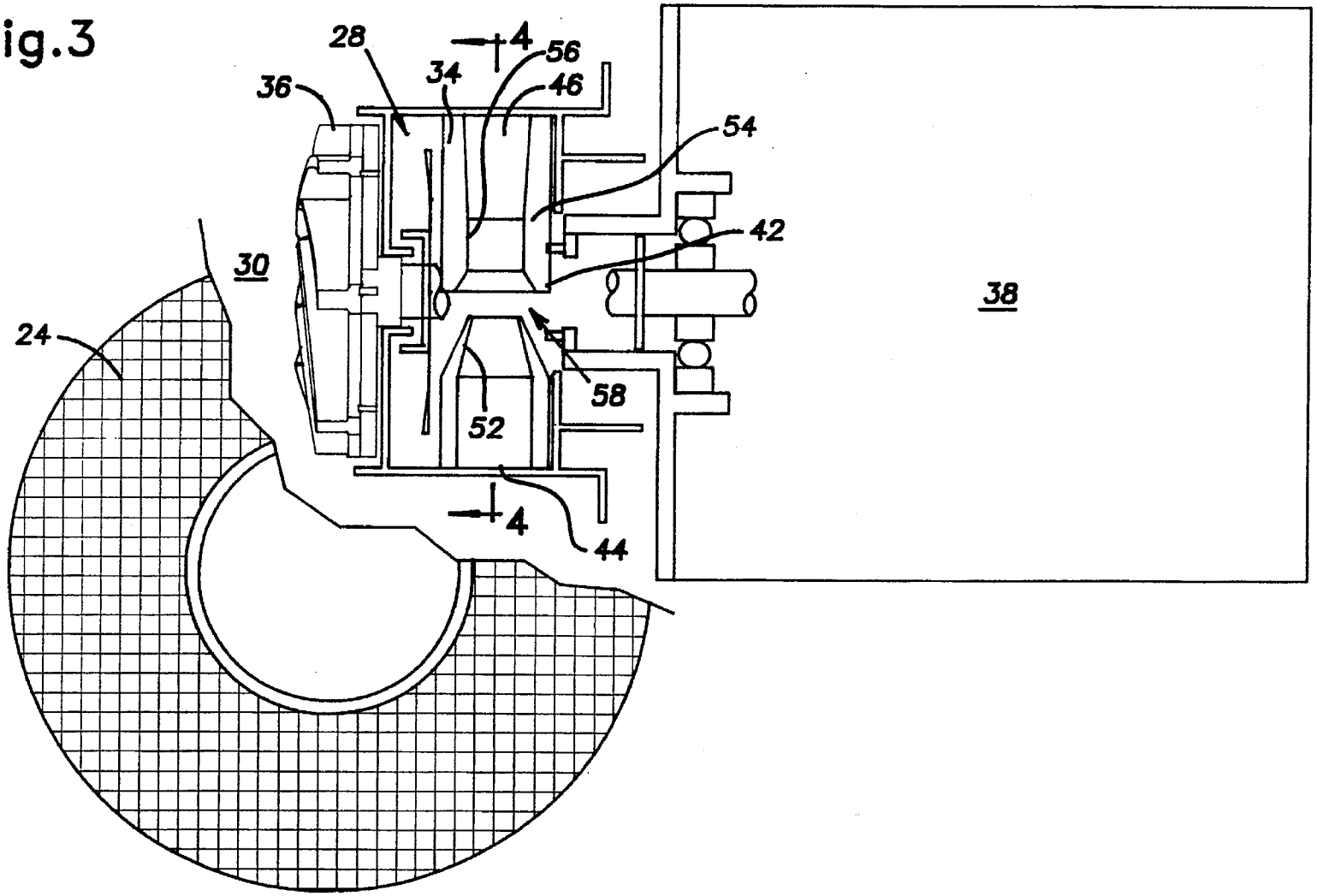
FIG. 3 shows a top view of the sump with part of a filter cutaway.
Figure 4:
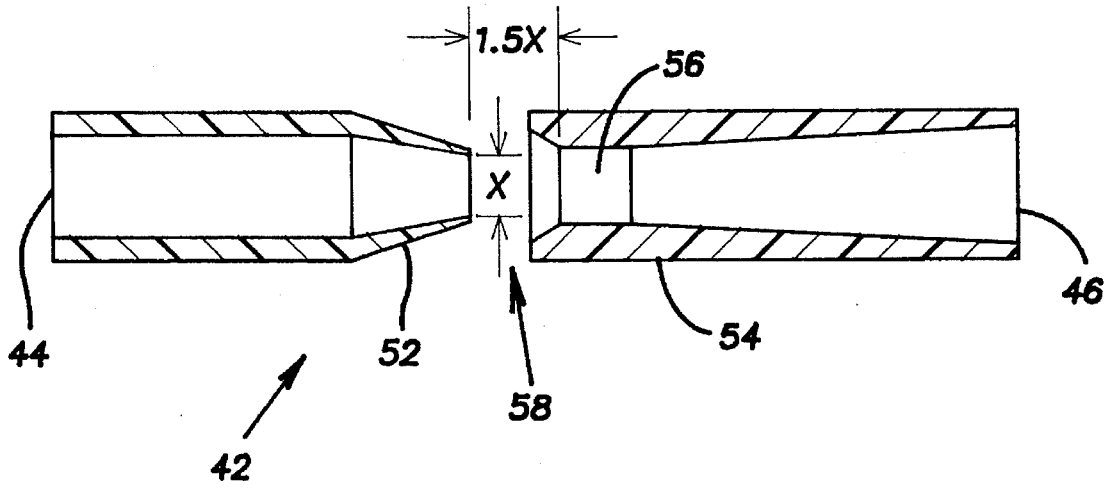
FIG. 4 shows an elevational view in a section taken from line 4—4 of FIG. 3 showing a detailed view of a venturi according to the invention.

Referring to FIGS. 3 and 4, the venturi 42 includes a nozzle 52 and a diffuser 54 defining a throat 56. A suction gap 58 between the nozzle 52 and the diffuser 54 communicates with the collection chamber 28. The venturi 42 is configured as an educator type jet pump. A relatively high pressure stream of wash liquid is directed through the nozzle 52, which is designed to develop a high velocity of liquid flow. The high velocity liquid creates a low pressure area in the diffuser 54 causing liquid and food particles from the collection chamber to flow into the diffuser 54 through the suction gap 58. In the diffuser, low velocity suction liquid from the collection chamber 28 mixes with the high velocity liquid. At the venturi outlet 46, the velocity of the mixed liquid reduces and the pressure increases.

Because of the uncertain and sometimes relatively high back pressures encountered from a drain system to which the venturi outlet 46 will be connected, the jet pump of the present invention should be configured differently from a theoretically ideal jet pump. In addition, the dishwasher has a relatively small volume of liquid in the pump chamber 30 that can be used for creating the suction. Therefore, the ratio of the flow rates of the two liquids (capacity ratio) is important because the liquid in the collection chamber 28 must be discharged before the pump chamber 30 is empty. Some efficiency may be sacrificed to improve the volume discharged from the collection chamber 28.

Referring to FIG. 4, calculation and experimentation have revealed that the end of the nozzle 52 should be spaced from the entrance to the throat 56 by about one and one-half times the diameter of the nozzle. Closer spacing yields better performance against high back pressures. Greater spacing provides more clearance for food particles. The nozzle diameter depends on the volume of water to be pumped from the pump chamber 30. The nozzle should converge at an angle of about 20° and the diffuser 54 should diverge at an angle of about 6°. The throat diameter is preferably the nozzle diameter divided by the square root of the nozzle to throat area ratio. Experimentation has, determined that a nozzle to throat area ratio of about 0.55 is suitable. Thus, the throat diameter can be about 1.35 times the nozzle diameter. The throat length is determined by the intersection of the throat with a diverging 6° cone defined by the diffuser 54 assuming the vertex of the cone is positioned at the nozzle 52 end.

During a wash operation, the diverter valve 60 is in a recirculate position (shown in phantom in FIG. 1). Wash liquid 16 from the pump chamber 30 is pumped through the conduit 40 and out of the spray arm 18 onto objects being washed. The wash liquid 16 flows down through the coarse filter 24 into the sump 14. Objects and large food particles are filtered by the coarse filter 24. The large food particles will eventually be eroded and dissolved until they pass through the coarse filter. The wash liquid continues flowing downwardly through the fine filter 26, which filters most of the food particles. The filtered wash liquid flows into the pump chamber 30, from where it is recirculated through the wash arm 18 by the pump 34. Food particles tend to move down the sloped horizontal component 26A of the fine filter 26 and the horizontal component 27A of the inner wall 27 toward the collection chamber 28. Wash liquid 16, containing food particles, that does not flow through the fine filter 26 flows into the collection chamber, where the food particles are collected. Wash liquid from the collection chamber 28 can be filtered and flow into the pump chamber 30 or can remain in the collection chamber 28.

When the wash operation is completed, the solenoid moves the diverter valve 60 to a drain position (shown in solid lines in FIG. 1). The pump 34 forces wash liquid from the pump chamber 30 through the U-pipe 45 to the venturi 42. The flow of wash liquid through the venturi 42 entrains wash liquid in the collection chamber 28 through the suction gap 58. The entrained wash liquid carries food particles from the collection chamber 28 through the diffuser 54 to the drain pipe 48. Draining continues until the liquid level in the pump chamber 30 is below the pump mouth 33 and, preferably, the collection chamber 28 is substantially empty. Substantially all of the food particles in the collection chamber are thereby discharged from the dishwasher 10. The diverter valve 60 is returned to the recirculating position for a subsequent wash cycle.

The present disclosure describes several embodiments of the invention, however, the invention is not limited to these embodiments. Other variations are contemplated to be within the spirit and scope of the invention and appended claims.

What is claimed is:

1. A washer drain system, comprising:

a wash chamber;

a sump in communication with the wash chamber, said sump having first and second sump chambers;

a venturi having an inlet in communication with the second sump chamber, a suction gap in communication with the first sump chamber, and an outlet communicable with a drain; and a pump connected for creating a liquid flow through the venturi from the second sump chamber to the drain so as to entrain material from the first sump chamber into the venturi and toward the drain.

2. A drain system according to claim 1, wherein the first sump chamber defines a collection chamber for collecting solid material.

3. A drain system according to claim 1, further comprising a filter disposed between the wash chamber and the second sump chamber.

4. A drain system according to claim 3, wherein the filter is sloped to direct food particles to the first sump chamber.

5. A drain system according to claim 3, wherein the filter separates the first and second sump chambers.

6. A drain system according to claim 5, wherein the filter defines a liquid flow path from the first sump chamber to the second sump chamber.

7. A drain system according to claim 3, wherein the filter separates the wash chamber from the second sump chamber so as to define a liquid flow path from the wash chamber to the second sump chamber.

8. A drain system according to claim 3, further comprising a second filter disposed between the wash chamber and the first sump chamber, the first filter being finer than the second filter.

9. A drain system according to claim 1, wherein the venturi comprises a jet pump.

10. A drain system according to claim 1, wherein the venturi includes a nozzle spaced from a diffuser to define the suction gap, the diffuser defining a throat and the suction gap being adapted to admit material in the first sump chamber into the throat to be conveyed to the drain.

11. A drain system according to claim 10, wherein an entrance to the throat is spaced from the nozzle by a distance approximately equal to one and one-half times a diameter of the nozzle.

12. A drain system according to claim 1, wherein the pump is operatively disposed between the second sump chamber and the venturi.

13. A drain system according to claim 12, wherein an inlet of the pump communicates with the second sump chamber and an outlet of the pump communicates with the inlet of the venturi.

14. A drain system according to claim 13, wherein the pump inlet extends below a bottom wall of the collection chamber.

15. A drain system according to claim 14, wherein a mouth of the pump inlet is generally horizontally disposed.

16. A drain system according to claim 13, wherein the pump outlet is communicable with the wash chamber.

17. A drain system according to claim 16, further comprising a valve for communicating the pump outlet with one of the wash chamber and venturi.

18. A drain system according to claim 1, wherein the system includes only the single pump.

19. A drain system according to claim 1, wherein the pump is unidirectional.

20. A drain system according to claim 1, wherein the pump is located in the sump.

21. A dishwasher drain system, comprising:

a sump having first and second sump chambers adapted to hold fluid from a wash chamber of the dishwasher;

a filter separating the wash chamber from the second sump chamber so as to direct food particles to the first sump chamber;

a pump having an inlet disposed in the second sump chamber; and a jet pump having an inlet in communication with an outlet of the pump, a suction gap in communication with the first sump chamber, and an outlet communicable with a drain, the pump being adapted to create a fluid flow from the second chamber through the jet pump so as to entrain material from the first sump chamber into the jet pump and toward the drain.

* * * * *